US009559414B2

(12) United States Patent
Karhuketo et al.

(10) Patent No.: US 9,559,414 B2
(45) Date of Patent: Jan. 31, 2017

(54) ARRANGEMENT FOR REDUCING INTERFERENCE IN AN ELECTRONIC SHELF LABEL

(75) Inventors: Hannu Karhuketo, Tuusula (FI); Gregory Wright, Fair Haven, NJ (US)

(73) Assignee: MARISENSE OY, Vantaa (FI)

( * ) Notice: Subject to any disclaimer, the term of this patent is extended or adjusted under 35 U.S.C. 154(b) by 543 days.

(21) Appl. No.: 13/698,392

(22) PCT Filed: May 31, 2011

(86) PCT No.: PCT/FI2011/050505

§ 371 (c)(1),
(2), (4) Date: Nov. 16, 2012

(87) PCT Pub. No.: WO2011/151518

PCT Pub. Date: Dec. 8, 2011

(65) Prior Publication Data

US 2013/0076586 A1 Mar. 28, 2013

(30) Foreign Application Priority Data

Jun. 1, 2010 (FI) ..... 20105616

(51) Int. Cl.
*H01Q 1/38* (2006.01)
*H01Q 1/52* (2006.01)
(Continued)

(52) U.S. Cl.
CPC ..... *H01Q 1/526* (2013.01); *G09F 3/208* (2013.01); *H01Q 1/085* (2013.01); *H01Q 1/2225* (2013.01);
(Continued)

(58) Field of Classification Search
CPC ..... H01Q 1/526
(Continued)

(56) References Cited

U.S. PATENT DOCUMENTS

2009/0289796 A1* 11/2009 Blumberg, Jr. ..... 340/572.1
2011/0063189 A1* 3/2011 Cohen et al. ..... 343/899

FOREIGN PATENT DOCUMENTS

WO WO 00/67110 A1 11/2000
WO WO 2004/025783 A1 3/2004
WO WO 2009/103857 A1 8/2009

OTHER PUBLICATIONS

C.C. Hsu, et al., "Design of MIMO antennas with strong isolation for portable applications," 2009 IEEE, Antennas and Propagation Society International Symposium, Charleston, USA, Jun. 1-5, 2009, pp. 1-4, ISBN 978-1-4244-3647-7, doi: 10-1109/APS.2009.5171635 section I, Fig. 3a.

(Continued)

*Primary Examiner* — Dameon E Levi
*Assistant Examiner* — Andrea Lindgren Baltzell
(74) *Attorney, Agent, or Firm* — Birch, Stewart, Kolasch & Birch, LLP

(57) ABSTRACT

An arrangement for reducing interference in a wireless electronic shelf label (ESL) (100) having a layered structure the ESL comprising: a display layer (101) comprising display material, a circuit board (203) with a backplane material structure and an antenna (202), and a circuit board arrangement with control electronics for controlling the operation of the label, such as the display and the radio communication, and a resilient layer having a space for a rigid component, such as a battery, wherein said resilient layer is arranged to provide a substantially even total thickness of said label (100), wherein the radio communication control further comprises means for radio frequency communication via modulated backscatter, wherein the arrangement is ring resonator arrangement isolating the ESL from the electrically conducting shelf arranged on the antenna circuit board, the ring resonator arrangement comprising a plurality of ring resonators (204) that are electrically isolated (Continued)

from the antenna and arranged at least on the side nearest the shelf when the ESL is attached to the shelf.

13 Claims, 3 Drawing Sheets

(51) Int. Cl.

| | |
|---|---|
| ***G09F 3/20*** | (2006.01) |
| ***H01Q 1/22*** | (2006.01) |
| ***H01Q 19/02*** | (2006.01) |
| ***H01Q 1/08*** | (2006.01) |
| ***H01Q 15/00*** | (2006.01) |

(52) U.S. Cl.
CPC ..... *H01Q 1/38* (2013.01); *H01Q 1/52* (2013.01); *H01Q 15/0086* (2013.01); *H01Q 19/021* (2013.01)

(58) Field of Classification Search
USPC ..... 343/841
See application file for complete search history.

(56) References Cited

OTHER PUBLICATIONS

D. Lee, et al., "Integration of a printed dipole antenna with a CLL-based volumetric metamaterial AMC block", 2005 IEEE Antennas and Propagation Society International Symposium, Washington, DC, USA, Jul. 3-8, 2005, vol. 2A, pp. 2-5, ISBN 0-7803-8883-6, doi: 10.1109/APS.2005.1551718 abstrac; second par., Fig. 1.

M. M. Bait Suwailam, et al., "Mutual coupling reducation in MIMO antennas using artificial magnetic materials", 13th International Symposium on Antenna Technology and Applied Electromagnetics and the Canadian Radio Science Meeting, ANTEM/URSI 2009, IEEE, Banff Canada, Feb. 15-18, 2009, pp. 1-4, ISBN 978 1-4244-2979-0, DOI: 10.1109/ANTEMURSI.2009.4805043, Abstract; Section 1; Figure1.

Y. Huang, et al., "Design of a low profile end-fire antenna using split-fire resonators", 2008 IEEE Antennas and Propagation Society International Symposium, San Diego, Jul. 5-11, 2008 (pp. 1-4) 978-1-4244-2041-4, doi: 10.1109/APS.2008.4619283.

* cited by examiner

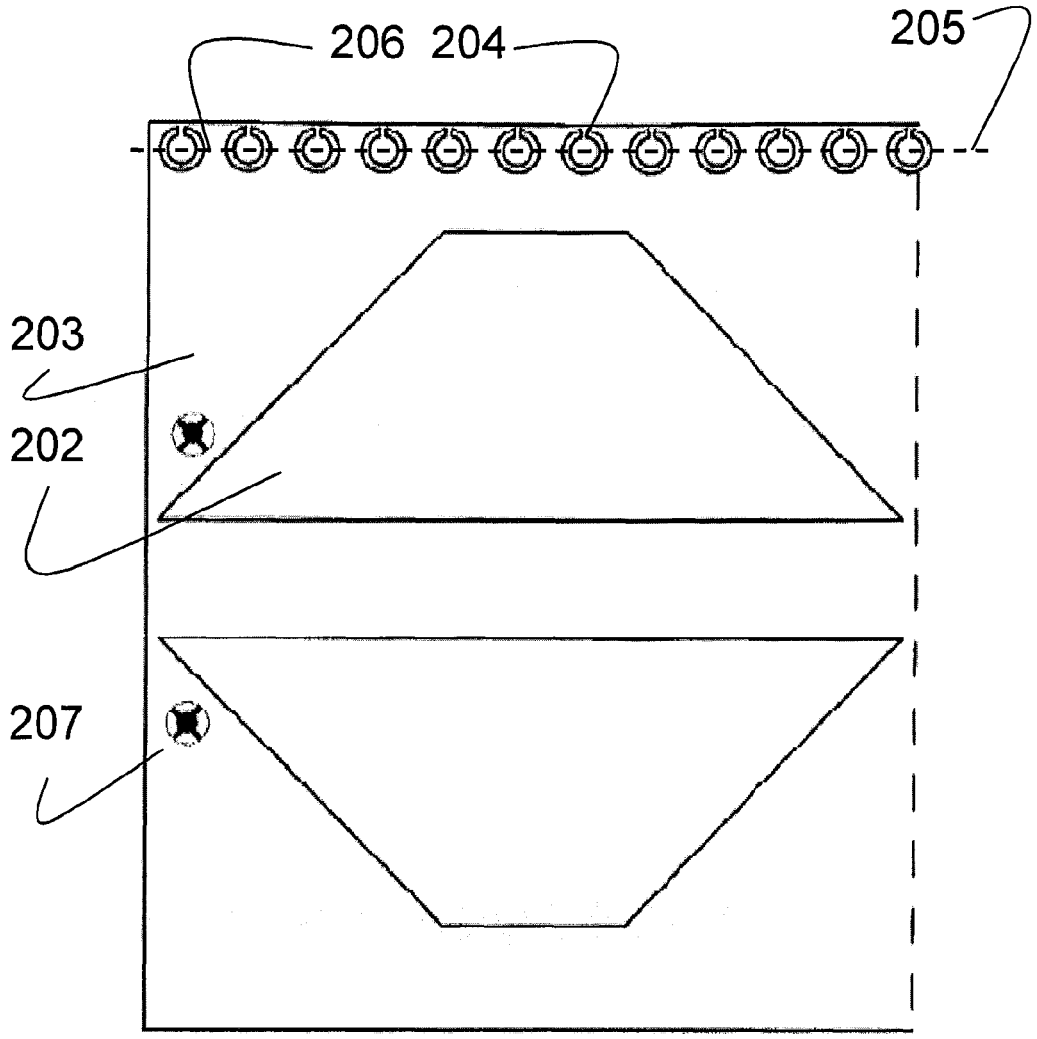
Fig. 3a
Fig. 3b
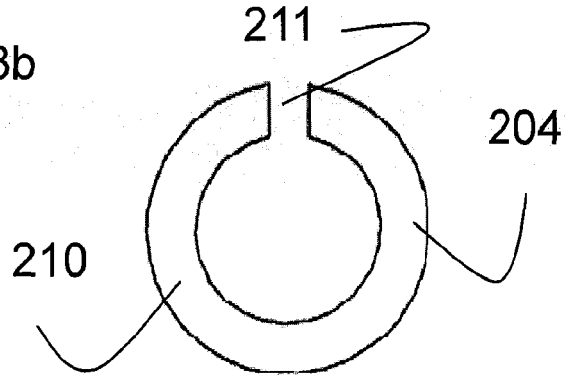

ARRANGEMENT FOR REDUCING INTERFERENCE IN AN ELECTRONIC SHELF LABEL

TECHNICAL FIELD

The present invention relates to electronic shelf labels (ESL's). More specifically, the present invention relates to an arrangement for reducing interference in an electronic shelf label.

BACKGROUND

Electronically controllable compact display units find new and wider applications continuously. A well-known and a steadily growing field of applications can be found in stores and warehouses, where instead of conventional paper price labels on the shelves, the prices and other product related information is displayed using electronic shelf labels.

The electronic shelf label system, also known by the acronym ESL, is a system used by retailers for displaying product pricing on shelves. Typically, electronic shelf labels are implemented as electronic display modules that are attached to the front edge of retail shelving. These modules use different technologies to show the current product price and also other information to the customer. A communication network allows the price display to be automatically updated whenever a product price is changed. This automated system reduces pricing management labor costs and improves pricing accuracy.

ESL's are particularly suitable for use in large shops or supermarkets that offer thousands or tens of thousands product items for sale, whose prices must be updated frequently and correctly.

The electronic display modules can be updated from a centralized control sys-tem via wired or wireless communication. All-wired systems have obvious problems in terms of the layout limitations caused by complicated cabling due to the high number of individual ESL displays. Wireless systems have their major technological bottleneck in the need for individual power supplies for each ESL display unit and requirement for long power supply lifetime, i.e. operational life-time for the batteries. In addition, the wireless systems need to be able to pro-vide dependable communication channel in an environment that has high number of individual receiver-transmitter units that in order to prolong the battery life, need to operate with minimum transmitting power levels.

A display technology that is suitable for ESL applications is a so called Electronic Paper Display (EPD) that possesses a paper-like high contrast appearance, ultra-low power consumption, and a thin, light form. EPD's aim to give the viewer the experience of reading from paper, while providing the capability to electronically update the displayed information. EPD's are technology enabled, as one possibility, by electronic ink. Such ink carries an electrical charge enabling it to be updated through electronics. Electronic ink is well suited for EPD's as it is a reflective technology which requires no front or backlight, is viewable under a wide range of lighting conditions, including direct sunlight, and requires no power to maintain an image. Electrical power is only consumed when the displayed data is changed. In order become widely applied in different type of applications, wireless ESL's or corresponding electronically controlled wireless displays are faced with a number of requirements that are partly dictated by the manufacturing process and partly by the end use, for example, the use, environment and manageability in a store by the store personnel.

WO 0067110 (A1) (E Ink Corporation) discloses a display unit for electronic shelf price label system that utilizes electronic ink and EPD technology. The electronic display unit in WO 0067110 features a printable electronic display comprising an encapsulated electrophoretic display medium. The resulting electronic display is flexible and has in large measure the applications of a printed display. Further, since the encapsulated electrophoretic display medium used in the present invention can be printed, the display itself can be made inexpensively. The encapsulated electrophoretic display medium is an optoelectronically active material which comprises at least two phases: an electrophoretic contrast media phase and a coating/binding phase. The electrophoretic display medium can form, for example, a full color, multi-color, or two color (e.g. black and white) display. The electrophoretic phase comprises at least one species of encapsulated electrophoretic particles, having distinct physical and electrical characteristics, dispersed in a clear or dyed suspending fluid. The coating/binding phase includes a polymer matrix that surrounds the electrophoretic phase. In this embodiment, the polymer in the polymeric binder is capable of being dried, crosslinked, or otherwise cured as in traditional inks, and therefore a printing process can be used to deposit the encapsulated electrophoretic display medium onto a substrate.

In ESL's from the manufacturing point of view, in the order to achieve truly low cost ESL's, a roll-to-roll or web-based manufacturing process is preferred. This brings about severe limitations to the encapsulation of the ESL's to be suitable for such manufacturing methods, for example, due to the requirement a certain level of flexibility of the structures. Typically not all of the components required in an ESL and having cost and technical performance at acceptable level are nowadays available as mechanically flexible structures and this limitation would need to be somehow addressed in the manufacturing methods.

In order for the ESL's to be easily manageable during the manufacturing process and in the following logistical steps, the encapsulation of the ESL's need to provide a somewhat flexible structure against damage and preferably even thickness of the encapsulation or casing without any protruding or intending rims or order structures. Reasons for such requirements arise from, for example, simple and easy packaging and delivery of the items to the end user from the manufacturer, any preparations, automated or manual, needed for the ESL's to be used in the shelves (often also including adding conventional printed information on the ESL's) and installation/mounting of the ESL's on the shelves or holders therein. ESL's undergo a lot of handling during the preparation before they are installed to those substantially permanent final locations in the shelves. This make the requirements for these display modules clearly different from those of, for example, small sized electronic devices to be personally carried out in pockets etc. This also opens up more possibilities to choose materials as well in many cases relieves requirements for the size/dimensions of the devices. Further, the structure and encapsulation of ESL's need to be such that the wireless communication with the control systems can be realized with minimal or negligible interference from the encapsulation itself or by the surrounding structures, such as the metal shelves that the ESL's are to be attached to in the shop.

In addition, the preferred shape of the encapsulated devices in some applications is not a straight card type shape, but in order to improve the visual appearance and readability, the ESL display can also have a slightly curved shape so that the displayed information appears on the outwards curved surface. Further, in many applications the extreme thinness of the product might not be preferable, because it can complicate the handling of ESL's.

WO 2009103857 (A1) (Marisense Oy) discloses a layered thin display unit for ESL's comprising a flexible display layer having display material, preferably epaper, a flexible backplane layer having an electrode structure for driving the display material, a rigid component and a resilient layer. The unit is provided with wireless communication means including an antenna that is arranged in the backplane layer. This thin layered structure enables a roll-to-roll or web-based manufacturing process.

The main benefits of the display modules according to WO 2009103857 lie in the mechanical resistance of substantially thin and flexible display module laminates against mechanical impacts, as well as in the completely smooth outer surface and even thickness to aid overall manageability. Further, the encapsulation technique results in casings that have good performance in respect to the wireless communication using an internal antenna. A further benefit is the fact that the visual appearance of the ESL's resembles paper sheets or paper labels that are familiar for the customers and that can also be placed in the same type of holders, pockets or space as the conventional paper labels. It further allows using such energy source, for example, battery solutions, that provide long operational lifetimes without high cost that would be inherent for more exotic battery technologies.

The ESL's may, like in WO 2009103857, be implemented as semi-active RF tags that may be powered from incident RF communicating via modulated backscatter. The backscatter technique is relatively sensitive to interference form adjacent metal objects. As the ESL's are attached to shelves which often are of electric conducting material, typically metal, these metal shelves induce RF interference to the ESL's that are attached to them.

PRESENT INVENTION

The object of the present invention is to avoid the problems of the prior art ESL's and achieve an ESL having less interference from adjacent shelves than the prior art ESL's.

The present invention is based on an idea that the antenna in the ESL is electrically isolated from the metal shelf by providing a plurality of small ring resonators, that are electrically isolated from the antenna, on the antenna circuit board between the shelf and the antenna, ie. on the side of the antenna circuit board that is nearest the shelf. In this way the interference from the shelf can be significantly reduced and the RF operation of the ESL improved.

The present invention related to the arrangement for reducing the interference from the adjacent shelf is in detail defined in claim 1 and preferred embodiments in other claims. The present invention is also related to the ESL provided with an arrangement according to claim 1 having less interference from the shelf.

BRIEF DESCRIPTION OF THE DRAWINGS

The foregoing, and additional objects, features and advantages of the present invention will be more clearly understood from the following detailed description of preferred embodiments of the present invention, taken in conjunction with accompanying drawings, in which:

FIGS. 3*a* and 3*b* present the antenna circuit board according to the present invention in a top view and a ring resonator in more detail.

DETAILED DESCRIPTION OF PREFERRED EMBODIMENTS

Figure 1:
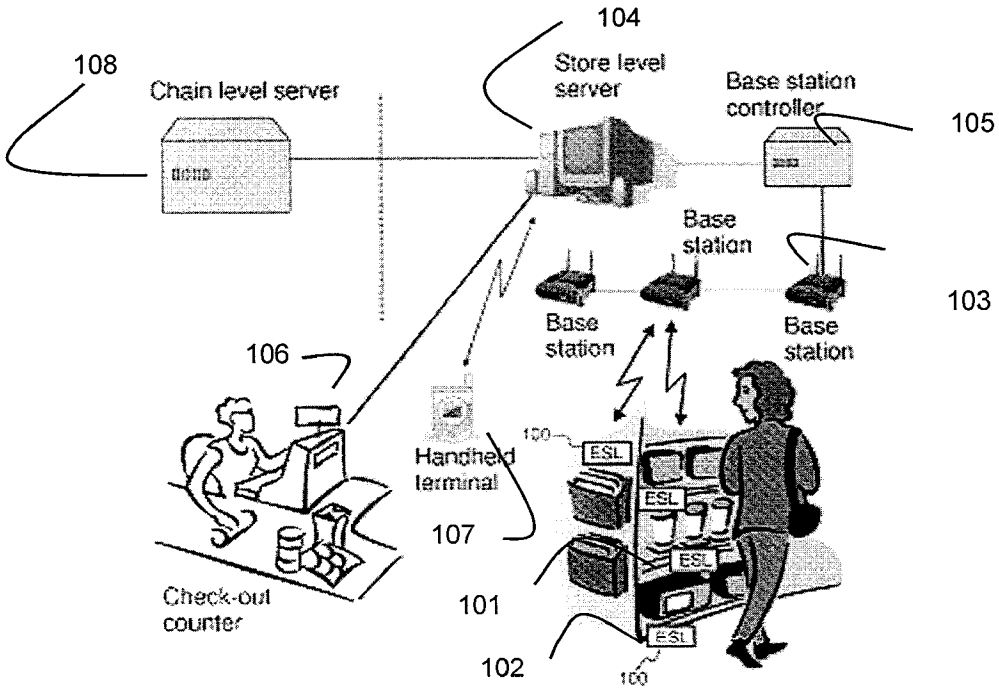
FIG. 1 presents an electronic shelf label system for displaying product pricing on shelves.

FIG. 1 shows an ESL (Electronic Shelf Label) system utilizing ESL's 100 implemented as a semi-active tag in a supermarket or similar sale environment where the shelves 101 are equipped with ESL displays that are typically attached in shelf rails carrying plastic ESL holders 102. ESL displays are placed in locations corresponding to the products on the shelves to be easily perceivable for the customers.

ESL displays communicate in a wireless manner with the base stations 103. This wireless communication method may is based on passive backscatter radio communication. In this approach the base stations actively send radio signals and instead of answering with active radio transmission, the ESL modules do not use a radio transmitter; instead, they answer by modulating the reflected power of the base station signal. The modulation is achieved, typically, by changing the load state of the ESL antenna in the ESL module, for example, by connecting and disconnecting the antenna between the ground and non-ground potential. This modulation of the backscattered signal allows for the ESL modules to answer to the base stations and further to the store level server 104.

Each ESL module can be identified by its own identification code that the ESL module in question knows to listen for in the transmission from the base station. After receiving new information, instructions or commands from the store server via bases station, the ESL module can acknowledge the reception of these instructions by using the reflected backscattering modulated properly and timely for the store level server to identify that the response is coming from the ESL module is question. To facilitate that the store server may have a certain listening period after a transmission directed to a certain ESL module for giving the module possibility to answer during that time.

Base stations are typically connected in a wired manner, for example, via Ethernet connection or via WLAN or corresponding wireless communication connection to a base station controller 105. This base station controller is further connected to controller software running in a store level server containing the price and other product information. Some retail chains may have the server only in the head office.

When price information is changed in the store level server locally according to pre-programmed instructions therein or manually by the shopkeeper or, remotely, from instructions received from a store chain level server 108, this information will be delivered through the base stations to individual ESL displays. The corresponding price information is also made available to the check-out counter 106 that is arranged in communication with the store level server. A further possibility for modifying the content of the information send to individual ESL displays is the use of a handheld terminal 107. A handheld terminal can be used by a member of the shop staff allowing him/her to freely move around in the shop and communicate in a wireless manner with the store level server and POS system. This communication can be achieved via a wireless communication network allowing using Personal Digital Assistant (PDA) type computing devices with inherent wireless communication capabilities. The handheld terminal can contain only limited functionalities or depending on the processing power of the device, it can be used to control the full capabilities of the application running in the store level server. In some applications in smaller shops with a fewer number of ESL displays, a handheld terminal may be used instead of a separate store level server. A mobile phone may also be used as a contacting means to the POS and further to the pricing system, too.

Further, the shop level server can be in connection with a chain level server that can provide identical price and product information to several stores belonging to the same chain of stores.

Figure 2:
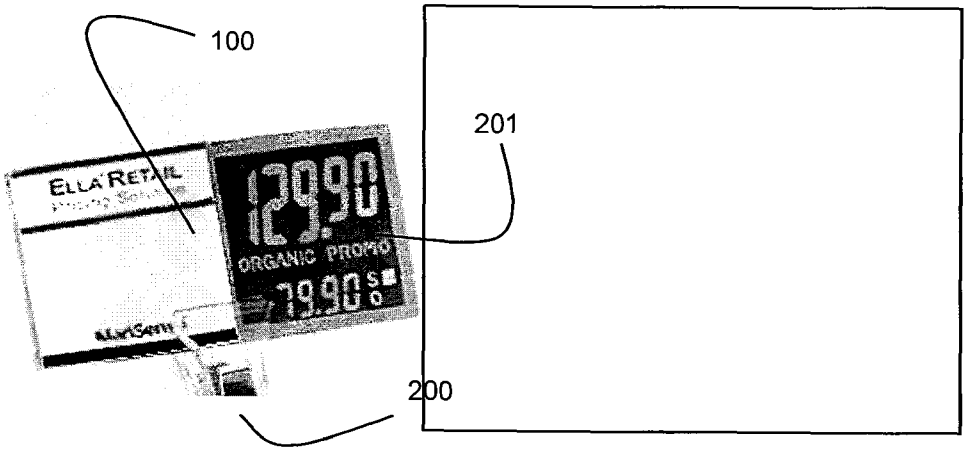
FIG. 2 presents an ESL module according to the present invention together with a plastic holder.

FIG. 2 shows an ESL display module 100 together with a plastic clip holder 200 where the display module is attached to the clip holder 200. The holder 200 can be attached, typically, to the front rail of a shelf and facilitates easy installation of the ESL display. The ESL module may also be attached directly to the shelf or to a self edge rail other structure without a separate holder.

In the example embodiment in FIG. 1, the size of the ESL module is approximately 90 mm (width)×45 mm (height)×2 mm (thickness). This gives the display module, or label a convenient size for convenient manual handling, occupying a suitably sized space in the shelf and also large enough text and numbers to be easily visible for a customer.

The above dimensions are just exemplary giving idea of the size class of the module. The size of the modules according to the invention can vary from these according to the application.

The ESL display module 100 in FIG. 2 has a layered structure. It consists essentially of a flexible epaper display layer 201 comprising epaper display material, a backplane layer as a flexible circuit board having an electrode structure (not shown) for controlling the display, a substantially rigid battery, wherein the thickness of said rigid battery is greater than the thickness of said flexible display layer and the thickness of said flexible backplane layer, and a resilient layer having a cut-out space for said rigid battery, wherein said resilient layer is arranged to provide a substantially even total thickness of said device.

The module further comprises wireless communication capabilities with an antenna 202 consisting of two triangular antenna patterns on the same flexible circuit board 203 as the display control (FIG. 3*a*), as the ESL is implemented as semi-active RF tags that is powered from incident RF communicating via modulated backscatter, and a separate flexible circuit board.

The rigid accumulator has been encapsulated in a cut-out space by laminating said display, backplane, control circuit board and resilient layers together. Further, the display layer, the backplane layer, the resilient layer and the rigid accumulator are located between two protective layers. The rigid component has been attached to the separate flexible printed circuit board operating as a sub-module under the backplane and the antenna.

Manufacturing of the ESL's is implemented basically on the web-type roll-to-roll manufacturing methods that is not described here in detail as it is not essential for this invention. The continuous web-shaped product may be die cut into individual labels 100.

The backplane and the antenna circuit board 203 and the ESL control circuit board are patterned plastic films (PET or PC or PVC or polyimid) with patterned conductive copper layers. The forming and patterning of the conductors can be made using any method known as such for a person skilled in the art, for example by direct printing of conductive ink or by etching of a thin metal layer. The lower surface of the backplane has display segment feed lines patterned in a similar way. Each display segment is electrically connected to a corresponding display segment feed line for example through a preferably laser processed via. Also other ways of providing feed-through vias are possible as is evident for a person skilled in the art. In order to establish an electrical contact from the backplane segments to the display front electrode, that is in this example on the front surface of the flexible electronic display web, an electrically conducting tape is laminated on the backplane area acting as a front electrode feed line. Alternatively and instead of an electrically conducting tape, electrically conducting paste or similar material with adhesive nature may be dispensed on the backplane web to make contact with the front plane electrodes.

Further, according to the present invention the ESL is electrically isolated from the metal shelf by providing a plurality of small ring resonators 204, that are electrically isolated from the antenna, on the antenna circuit board between the shelf and the antenna, ie. on the side of the antenna circuit board that is nearest the shelf. The ring resonators comprise a ring 210 and an opening 211 in the ring whereby the ring operates as an inductor and the opening as a capacitor. The ring resonators are all arranged on the common centre line 205 that is parallel with the edge 206 of the circuit board that is nearest the shelf. The ring resonators have all the same diameter that is essentially smaller than the width of the ESL, typically 5-10 mm. In this way the interference from the shelf can be significantly reduced and the RF operation of the ESL improved. The ring resonators may additionally be arranged on an other side of the board, for instance at the antenna coupling end near the antenna signal connect points 207 on the circuit board.

As a further advantage, the manufacturing process according to the invention gives possibility to manufacture display labels that can be made curved in shape. This can be done by adjusting the tension between the different laminated layers together with proper selection of materials. The upper surface of the display label 100 may be e.g. convex or concave.

The invention provides possibility to manufacture display module structures that despite of their significant thickness, at least more than 1 mm but typically in the range of 2 mm, have certain amount of flexibility and still maintain well their original shape, Further, the encapsulated display modules 100 can be made very light compared to their size, which makes the convenient and easy to handle both manually and automatically. In prior art products and encapsulation methods, increasing thickness typically decreases the flexibility, whereas in the products according to the invention the flexibility and the benefits therein are preserved better even if conventional rigid components are to be used as a part of the device ESL.

The invention claimed is:

1. A wireless electronic shelf label (ESL) having a layered structure comprising:

a display layer comprising display material, an antenna circuit board with a backplane material structure, a far field antenna disposed on the antenna circuit board, a circuit board arrangement with control electronics for controlling the operation of the label, including the display and radio communication control, and a resilient layer having a space for a rigid component, such as a battery, wherein said resilient layer is arranged to provide a substantially even total thickness of said label, wherein the radio communication control further comprises means for radio frequency communication via modulated backscatter, wherein the ESL further includes an arrangement for reducing interference which comprises a split ring resonator arrangement, arranged on the antenna circuit board to isolate the ESL from an electrically conducting shelf to which the ESL is attached, and wherein the split ring resonator arrangement comprises a plurality of ring resonators, as separate structures that are electrically isolated from the antenna but are printed on the same layer of the antenna circuit board and arranged at least on a side nearest the shelf to which the ESL is attached.

2. The wireless electronic shelf label according to claim 1, wherein the ring resonators are arranged at least on a common centre line that is parallel with an edge of the circuit board that is nearest the shelf.

3. The wireless electronic shelf label according to claim 1, wherein the ring resonators have all the same diameter which is essentially smaller than the width of the ESL.

4. The wireless electronic shelf label according to claim 1, wherein the ring resonators may additionally be arranged on another side of the board.

5. The wireless electronic shelf label according to claim 1, wherein the split ring resonators comprise a ring and an opening in the ring, whereby the ring operates as an inductor and the opening as a capacitor.

6. The wireless electronic shelf label according to claim 1, having an arrangement for reducing the interference.

7. The wireless electronic shelf label according to claim 6, wherein the antenna and the split ring resonators are arranged on separate sides of a circuit board or on separate circuit boards arranged onto each other.

8. The wireless electronic shelf label according to claim 6, wherein the circuit board for said antenna and control electronics is flexible.

9. A wireless electronic shelf label according to claim 2, having an arrangement for reducing the interference.

10. A wireless electronic shelf label according to claim 3, having an arrangement for reducing the interference.

11. A wireless electronic shelf label according to claim 4, having an arrangement for reducing the interference.

12. The wireless electronic shelf label according to claim 7, wherein the circuit board for said antenna and control electronics is flexible.

13. The wireless electronic shelf label of claim 3, wherein the split ring resonators have a diameter which is less than 20% of the width or length of the circuit board.

* * * * *